United States Patent [19]

Goldfarb et al.

[11] 4,183,535

[45] Jan. 15, 1980

[54] GAME WITH INCLINED SURFACES AND INTERCEPTORS

[76] Inventors: Adolph E. Goldfarb, 4614 Monarca Dr., Tarzana, Calif. 91356; Erwin Benkoe, deceased, late of Encino, Calif.; by Elisabeth Benkoe, executrix, 17965 Medley Dr., Encino, Calif. 91316

[21] Appl. No.: 876,645

[22] Filed: Feb. 10, 1978

[51] Int. Cl.[2] ..... A63F 7/02

[52] U.S. Cl. ..... 273/120 R; 273/129 F

[58] Field of Search ..... 273/86 C, 120 R, 120 A, 273/119 B, 85 H, 129 F, 95 C

[56] References Cited

U.S. PATENT DOCUMENTS

| | | | |
|---|---|---|---|
| 346,092 | 7/1886 | Croswell | 273/120 R |
| 1,576,140 | 3/1926 | Schneider | 273/120 R |
| 1,827,885 | 10/1931 | Emenhiser | 273/119 B |
| 2,782,037 | 2/1957 | Rovira | 273/120 R |
| 3,038,725 | 6/1962 | Stewart et al. | 273/119 B |
| 3,879,039 | 4/1975 | Holden | 273/86 C |
| 4,086,902 | 5/1978 | Reynolds | 124/61 |

*Primary Examiner*—Richard C. Pinkham
*Assistant Examiner*—Lawrence E. Anderson
*Attorney, Agent, or Firm*—Robert M. Ashen; Robert J. Schaap

[57] ABSTRACT

A game which includes a downwardly inclined primary pathway or track. The track may be serpentine and a first player attempts to roll an object such as a marble down the track. One or more interception devices are positioned along the track. These devices may take the form of a movable striker which will move, when actuated, into the path of a marble moving down the track. The striker may be operated by the opposing player through a manually actuatable control mechanism. The second player attempts to intercept the ball of the first player and divert it into a secondary pathway. The scoring of the game may depend on the ball reaching the end of the primary track or being intercepted and diverted into a secondary pathway. Preferably, the apparatus includes a pair of the inclined primary tracks leading and inclined downwardly in opposite directions. Thus, each player is at one end of the apparatus and is both starting marbles down one primary track, and also operating a control mechanism to try to intercept and divert marbles from his opponent's track. In one form, each control mechanism may include an air system made up of a squeezable air bulb connected through an air line to an air cylinder-piston unit. When the piston is actuated, it strikes a captive ball which rolls and strikes a free-swinging striker that is thereby swung into the path of marbles moving down the associated primary track. This form of control mechanism imparts a momentary swing to the striker into the path of the marbles but prevents the striker from being held in that position.

13 Claims, 3 Drawing Figures

GAME WITH INCLINED SURFACES AND INTERCEPTORS

The present invention relates generally to competitive play apparatus of the general type where each of the competing players is involved in a plurality of physical activities which utilizes concentration, skill and timing.

In the illustrated apparaus, each player is directing play pieces toward a desired goal while at the same time he is operating intercepting or divering means to try to intercept play pieces directed by his opponent before they can reach that opponent's goal. Each player rolls marbles down a serpentine inclined primary path or track toward his own goal. At the same time, each player has intercepter means which he may operate to attempt to divert his opponent's marbles so they will not reach the opponent's goal, but rather so that they will be usable by that player on his own track. The tracks are arranged generally side-by-side but leading in opposite directions, so each player may be postioned at one end of the apparatus and will have marbles proceeding both toward and away from him at the same time to add to the excitement and play of the game Applicant is not aware of a similar device in the prior art. One prior art device known as "Criss-Cross" comprises a game board having a serpentine track for a marble, with the serpentine track being intercepted at various points by a second straight track. The opponent would roll marbles down the straight track in an effort to intercept the movement of marbles along the serpentine track. This prior apparatus did not permit both players to simultaneously advance their own marbles while trying to intercept the marbles advanced by the opponent.

Figure 1:
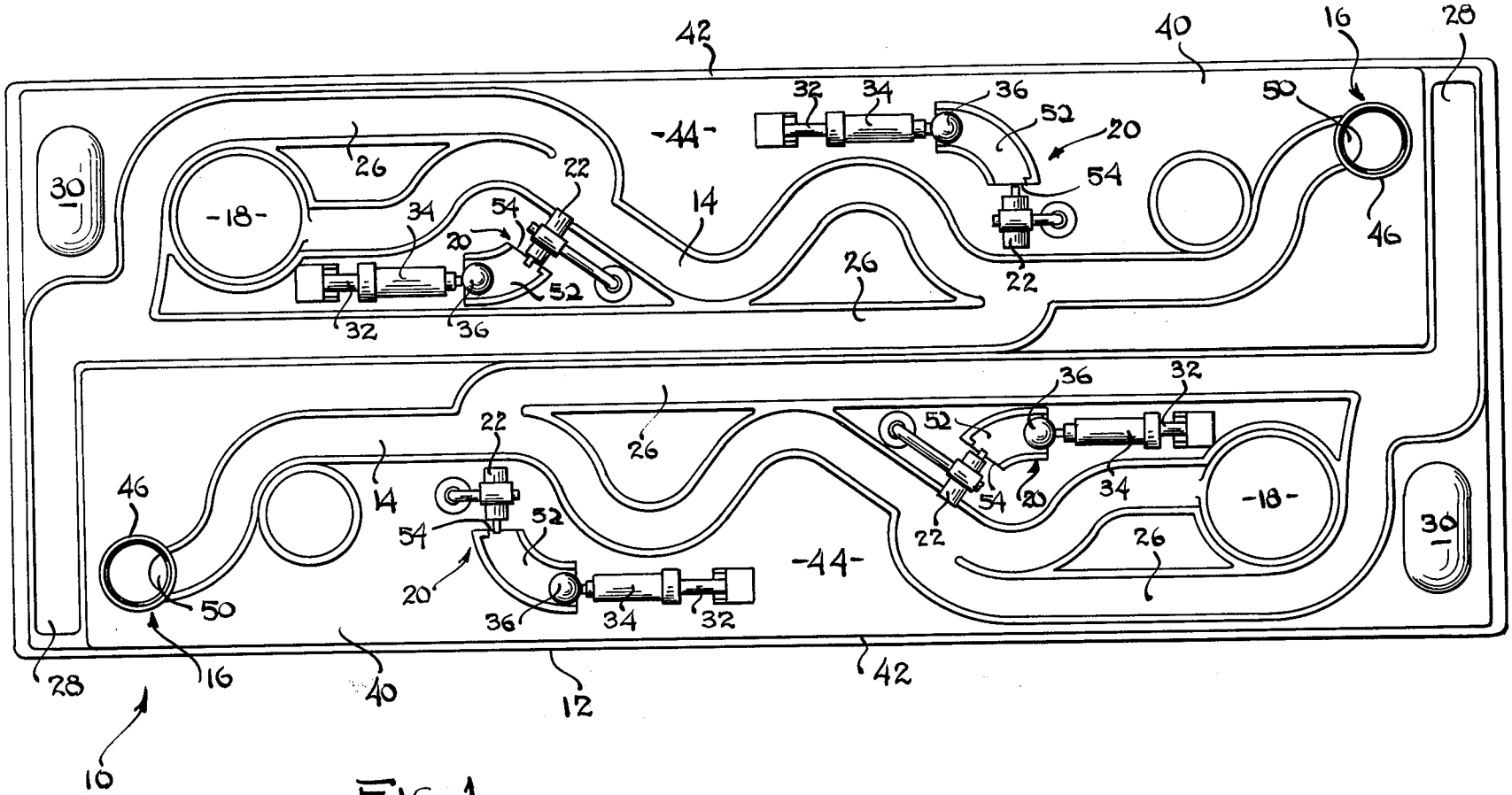
FIG. 1 is a top plan perspective view of a play apparatus which is a presently preferred embodiment of the present invention.

In general, the illustrated competitive game apparatus 10 comprises a playing board or frame 12 which is generally elongated and has a pair of opposed ends. There are a pair of primary tracks or pathways 14 which extend generally parallel to one another and longitudinally of the board. Each track 14 has a starting end 16 and a goal or receptacle 18 at its finishing end and each track inclines downwardly from its starting end. Along each track are intercepter means 20 in the form of movable strikers 22 which are operable to move into the path of rollable objects such as balls 24 which are rolled along the paths or tracks to divert the balls onto secondary tracks 26. When so diverted, the balls do not reach the goals 18 at the end of the primary tracks 14, but rather move along the secondary track to the opponent's supply receptacle 28, from where he may take them and use them for travel down his own primary track. Thus, each player is positioned at one end of the board 12 where his primary track 14 begins. At each end of the play board there is also an actuator 30 for operating the intercepter means 20 along the opponent's primary track. In the illustrated apparatus the actuator 30 takes the form of an air bulb. The bulb 30 is connected through an air line 32 to an air cylinder-piston unit 34. The unit 34 is operable to strike and propell a captive ball 36, which in turn strikes and propells the free-swinging striker 22 into the path of the adjacent primary track. Thus, at each player end there is the start of that player's primary track 14 leading to his goal 18 and there is also an actuator 30 to operate the intercepter means 20 associated with the opponent's primary track. Both players try to roll the balls down their own primary tracks toward their own goals while at the same time operating their actuators to prevent balls moving down the opponent's primary track from reaching the opponent's goal. When a player is successful in diverting a ball from the opponent's primary track that ball is diverted to the diverting player's supply receptacle at his end of the board from where he can use that ball to roll down his own primary track. The game may be played until all of the balls are in one goal or the other, with the player having the highest number of balls in his goal being the winner.

The game may also be played for a limited time period, with the player having the larger number of balls in his goal at the end of that period being the winner. Further, the running score may be kept with the winner being the player having had the highest number of balls in his goal after two or more sessions of either limited time duration or where all the balls have found their way to one goal or the other.

Figure 2:
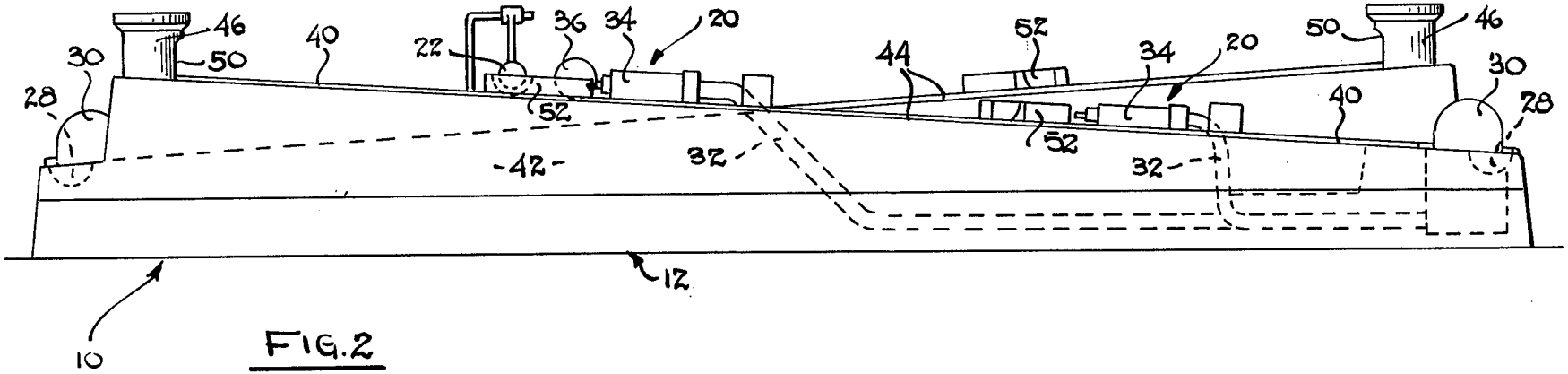
FIG. 2 is a side sectional view of the apparatus.
Figure 3:
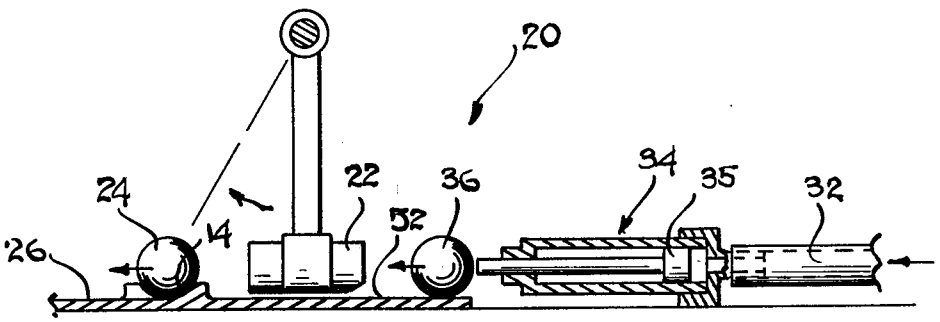
FIG. 3 is an enlarged schematic perspective view of one intercepter means of the apparatus.

Now considering the illustrated play apparatus 10 in further detail, as shown in FIGS. 1 and 2, the playing board or frame 12 has a pair of inclined upper walls 40 which each extend lengthwise of the frame and are inclined downwardly from opposite ends. The frame 12 also includes supporting side walls 42. The frame may be constructed of a suitable material such as molded plastic, metal, wood, etc. Each inclined upper wall 40 has an upper playing surface 44 on which one of the primary tracks or pathways 14 is provided. The illustrated tracks 14 are generally winding or serpentine and each extends generally longitudinally from the elevated end of its playing surface 44 to the lower end where it terminates in the goal 18 which may be in the form of a recess or depression in the playing surface in communication with the lower finishing end of the track. Each of the tracks 14 may be formed by a depression in the playing surface 44 or it may be formed by a spaced-apart pair of elevated rail portions or sections defining the track or pathway between them. For a player to start one of his play pieces down his track, a starter tube 46 is provided at the starting end 16 of each track. Each of the illustrated tubes 46 extends upwardly from the associated playing surface 44 being open at its upper end and having an aperture 50 in its side wall which is in communication with the start of the associated track.

Each illustrated primary track 14 is provided with a pair of the secondary tracks 26 which extend somewhat transversely away from that primary track and proceed down the associated incline playing surface but do not lead to the goal associated with that track. Rather, the secondary tracks 26 lead to the opponent's supply receptacle 28 at the other side of the playing board and adjacent to the start of the opponent's primary track. The secondary tracks may be formed in a similar manner to the primary tracks and the supply receptacles may be formed by depressions in the playing board.

The illustrated playing objects 24 are rollable and in the preferred form are small balls or marbles. At the start of play, each of the players may be provided with a plurality of the marbles 24 in his or her supply receptacle. Each player then uses these balls by placing them into the top of his starting tube 46 from where they roll down the incline and along his primary track 14 toward his goal 18.

In the illustrated apparatus 10, each primary track 14 is provided with a pair of the intercepter means 20, each located adjacent to the track 14 at a location where it is intersected by a secondary track 26. As noted above, each intercepter means 20 of the illustrated toy apparatus comprises a freely swinging striker 22 whose swinging movement carries it momentarily into the path of a marble traveling along the adjacent primary track. Each striker 22 is positioned and arranged so that when it engages a marble on the primary track it will divert the marble from that track onto the associated secondary track.

The strikers 22 of the intercepter means 20 associated with each primary track 14 are selectively operated by the opponent player. In the illustrated apparatus, one of the actuator air bulbs 30 is positioned at the lower end of each of the inclined playing surfaces 44, with an upper portion of each bulb being exposed so it can be manually depressed by the hand of a player. Each bulb 30 is connected through one of the air lines 32 which extend underneath the associated inclined playing wall 40 to one of the air cylinder piston units 34 mounted atop that inclined wall. Each unit 34 includes an air piston 35 reciprocally movable in the cylinder of the unit. The piston 35 is moved forwardly when the air bulb 30 is depressed. When the air bulb 30 is released, the piston 35 will retract.

In front of each piston 35 there is a short track 52, along which the associated rollable element 36 is confined and moves. Each track 52 is inclined downwardly toward the associated piston unit 34 so that the associated rollable element 36 will tend to position itself in contact with the front of that unit. When the piston 35 is thrust forwardly, it strikes the element 36 which may be a ball or marble. The marble 36 is thus rolled forwardly along track 52. The marble in turn strikes the associated free-swinging striker 22 which is arranged so that it will normally assume a position with its lower end leaning against the forward end 54 of the side rails forming the associated track 52. Thus, for each interceptor means, when the piston 35 is caused to move forwardly by depressing the air bulb 30, the marble 36 is thereby engaged and caused to roll forwardly to engage the swingable striker 22. The striker then swings momentarily into the path of the marbles moving along the opponent's primary track. As noted above, the element 36 rolls back to its starting position and the striker swings back to its starting or at rest position.

Thus, each player trys to actuate his air bulb to cause the associated stikers to cross the path of the on-coming marble in the opponent's primary track so as to divert the marble from that track onto a secondary track. It will be noted that there is some delay between actuating the air bulb and the strikers actually swinging, which the player must take into account. Each player thus concentrates not only actuating his own interceptor means by pushing his air bulb, but also on the timing of releasing balls from his starting tube to try to avoid their being intercepted, as for example by overloading the opponent with several closely spaced marbles moving down the track.

What is claimed is:

1. A competitive play apparatus for competitive play by two players, where each player may generally simultaneously launch playing balls down that player's track while operating interception means to affect movement of playing balls on the opponent's track, said apparatus comprising:

(a) a frame having a pair of spaced apart, opposed player positions and defining a pair of upper playing surfaces, each surface having a starting end at one player position and extending longitudinally to an opposite end at the other player position, each surface being inclined downwardly from said starting end toward said opposite end, said surfaces being side-by-side with the starting end of each adjacent to the opposite end of the other;

(b) means on each of said surfaces defining a track for playing balls to roll along, said tracks each leading generally from the starting end of the associated surface toward the opposite end of that associated surface;

(c) a pair of interception means each disposed at a location intermediate the ends of one of said surfaces and adjacent to the said track on said associated surface, said interception means each being actuatable to affect the movement of a playing ball rolling along the associated track; and (d) a pair of manually actuatable remote control means each having a control member located at the starting end of one of said tracks at one of said player positions and being operatively associated with the interception means at the other of said tracks, each of said remote control means being selectively operable to actuate for only a limited time period the associated interception means.

2. The apparatus of claim 2 further comprising a pair of goal-receptacles, each at the end of one of said tracks for receipt therein of the rollable balls that travel the full length of the associated track.

3. The apparatus of claim 3 wherein said tracks are generally serpentine.

4. The apparatus of claim 4 further including a plurality of playing balls.

5. The apparatus of claim 5 wherein each of said interception means comprises at least one freely swingable striker member pivotally supported above the playing surface adjacent to the associated track and movable momentarily into the path of a ball moving along the track.

6. The apparatus of claim 6 wherein each of said interception means comprises a plurality of said striker members, each at a different location along said associated track.

7. The apparatus of claim 1 further including a secondary track disposed adjacent to each of said first-mentioned tracks for receipt of the play balls whose movement is affected by said interception means, said secondary tracks each leading to a different place than does said first mentioned track.

8. The apparatus of claim 7 further comprising a receptacle at the end of each of said secondary tracks.

9. The apparatus of claim 9 wherein each of said control means comprises an actuator mechanism and a freely movable intermediate element for being engaged by said actuator mechanism to momentarily engage said interception means.

10. The apparatus of claim 9 wherein each of said actuator mechanisms comprise a compressible actuator air bulb means, an air line connected at one end to said bulb means, and an expandible engaging means connected to the other end of said air line.

11. The apparatus of claim 10 wherein each of said expandible engaging means comprises an air cylinder and a piston movable in said cylinder to engage and move said intermediate element.

12. The apparatus of claim 10 wherein each of said air bulb means are located at said opposite end of the associated playing surface.

13. The apparatus of claim 12 wherein said air bulb means are mounted on said frame.

* * * * *

UNITED STATES PATENT OFFICE

CERTIFICATE OF CORRECTION

PATENT NO. : 4,183,535

DATED : January 15, 1980

INVENTOR(S) : Adolph E. Goldfarb, et al.

It is certified that error appears in the above-identified patent and that said Letters Patent are hereby corrected as shown below:

In Claim 2, line 1, change "Claim 2" to Claim 1.

In Claim 3, line 1, change "Claim 3" to Claim 1.

In Claim 4, line 1, change "Claim 4" to Claim 1.

In Claim 5, line 1, change "Claim 5" to Claim 1.

In Claim 6, line 1, change "Claim 6" to Claim 5.

In Claim 9, line 1, change "Claim 9" to Claim 1.

Signed and Sealed this

*Third* Day of *June 1980*

[SEAL]

*Attest:*

SIDNEY A. DIAMOND

*Attesting Officer*

*Commissioner of Patents and Trademarks*